US008002037B2

(12) United States Patent
Booth

(10) Patent No.: US 8,002,037 B2
(45) Date of Patent: Aug. 23, 2011

(54) DOWNHOLE CLEANING TOOL AND METHOD OF USE

(75) Inventor: Richard K. Booth, Onchan (IM)

(73) Assignee: Hamdeen Incorporated Limited (IM)

( * ) Notice: Subject to any disclaimer, the term of this patent is extended or adjusted under 35 U.S.C. 154(b) by 140 days.

(21) Appl. No.: 12/204,333

(22) Filed: Sep. 4, 2008

(65) Prior Publication Data

US 2009/0218092 A1 Sep. 3, 2009

(30) Foreign Application Priority Data

Sep. 4, 2007 (GB) ..... 0717163.0

(51) Int. Cl.
*E21B 37/00* (2006.01)
*E21B 37/02* (2006.01)

(52) U.S. Cl. ..... 166/311; 166/170; 166/174; 166/173

(58) Field of Classification Search ..... 166/311, 166/381, 170, 174, 173
See application file for complete search history.

(56) References Cited

U.S. PATENT DOCUMENTS

| | | | | |
|---|---|---|---|---|
| 2,203,966 | A * | 6/1940 | Otis | 166/174 |
| 2,216,674 | A * | 10/1940 | Miller et al. | 166/174 |
| 2,679,293 | A * | 5/1954 | Garrison | 166/174 |
| 3,105,555 | A | 10/1963 | Villalon, Jr. | |
| 3,251,418 | A | 5/1966 | Condra | |
| 4,558,738 | A * | 12/1985 | Howard, Sr. | 166/173 |
| 6,408,945 | B1 * | 6/2002 | Telfer | 166/311 |

FOREIGN PATENT DOCUMENTS

WO 93/16833 A1 9/1993

* cited by examiner

*Primary Examiner* — Kenneth L Thompson
*Assistant Examiner* — Cathleen Hutchins
(74) *Attorney, Agent, or Firm* — DLA Piper LLP (US)

(57) ABSTRACT

A downhole cleaning tool comprising: a substantially cylindrical body; at least one cleaning member extending from the cylindrical body and being movable between a retracted position and an active position in which the cleaning member is positioned to clean an internal surface of the well bore; and switching means adapted to receive a force applied in a first direction and responsively move the at least one cleaning member from the retracted position to the active position.

16 Claims, 6 Drawing Sheets

DOWNHOLE CLEANING TOOL AND METHOD OF USE

FIELD OF THE INVENTION

The present invention relates to downhole cleaning tools, and in particular to downhole cleaning tools that are connectable within a drill string and which can be inserted into a well bore to carry out scraping of the well bore casing.

BACKGROUND

A casing is provided in a well bore for a number of reasons, including isolating different zones in the drilled formation from one another, providing a strong upper foundation for the drilling fluid, and providing a smooth internal bore for installing production equipment. The casing comprises a number of steel pipes known as strings that are connected together as they are run into the bore. Each casing string will have a subsequently smaller diameter than the casing string above it.

A casing string that does not extend to the top of the well bore, but instead is anchored or suspended from inside the bottom of the previous casing string, is known as a liner. The liner therefore has a top edge which defines a step change in the internal diameter within the well bore. The use of liners can result in a substantial saving in material costs.

During the cementing process, cement slurry is first pumped down the internal bore of the casing and then displaced using another fluid, typically mud, from the lower end of the casing and up into the annular space between the casing and the rock formation. Nearer the surface, the annular spacing will be between the casing and a larger casing that was previously cemented in place.

Some of the cement slurry will adhere to the internal wall of the casing. In particular, when liners are used, slurry will accumulate at the step change in internal diameter at the top of the liner.

It is known to use scraper tools to clean the inside of a casing and remove the cement from the inside surface of the casing. The particles of cement and other debris which arise from the scraping operation can then be removed by the circulation of well fluid such as drilling mud or brine through the well.

Typically, the scraper tool comprises a cylindrical body and a number of scraping blades extending from the cylindrical body. A hypothetical "scraping diameter", defined by the extending blades, is designed to be substantially equal to the internal diameter of the casing string to be scraped so that the scraping blades contact the casing to allow cleaning of the internal surface of the casing string.

However, known scraping tools do not provide an adequate scraping action at the top of the liner where significant amounts of slurry will accumulate. Also, contact with the top of the liner on the side of the blades can cause damage to, or bending of, the blades which impairs performance. Known tools also suffer from the disadvantage that further debris can be dislodged during extraction of the tool from the well hole, so that debris remains in the well hole after the cleaning operation.

SUMMARY OF THE INVENTION

According to a first aspect of the present invention, there is provided a downhole cleaning tool comprising:

a substantially cylindrical body;

at least one cleaning member extending from the cylindrical body and being movable between a retracted position and an active position in which the cleaning member is positioned to clean an internal surface of the well bore; and switching means adapted to receive a force applied in a first direction and responsively move the at least one cleaning member from the retracted position to the active position.

The term "internal surface of the well bore" is intended to include the internal surface of casings or liners inserted within the well bore.

Preferably the tool is a scraper tool. Preferably the at least one cleaning member comprises a scraping blade. Preferably the scraping blade contacts the internal surface of the well bore when the cleaning member is at the active position.

Preferably a plurality of cleaning members are provided. Preferably four cleaning members are provided.

Preferably the downhole cleaning tool includes mounting means for mounting the at least one cleaning member. Preferably the mounting means comprises a mounting slot. Preferably the mounting means is adapted to allow lateral movement of the cleaning member relative to the cylindrical body when the switching means receives a force applied in the first direction. The term "lateral" is intended to cover any direction other than the direction in which the cleaning member extends from the cylindrical body.

Preferably the downhole cleaning tool is adapted such that the mounting means takes up the received force after sufficient lateral movement of the cleaning member. Preferably the mounting means is adapted to contribute to the cleaning of the internal surface of the well bore when the cleaning member is at the active position.

Preferably the switching means includes biasing means for biasing the or each cleaning member towards the active position. Preferably the switching means includes retaining means for selectively retaining the or each cleaning member at the retracted position. Preferably the retaining means retains the or each cleaning member at the retracted position until the cleaning member has moved laterally relative to the cylindrical body. Preferably the mounting means is adapted to allow the cleaning member to move outwards relative to the cylindrical body following sufficient lateral movement of the cleaning member relative to the cylindrical body.

Preferably the retaining means includes the mounting slot. Preferably the mounting slot comprises an 'L' shaped slot. Alternatively, the mounting slot comprises a 'C' or 'S' shaped slot.

Preferably the lateral movement of the cleaning member is parallel to the longitudinal axis of the cylindrical body. In an alternative embodiment, the mounting means may be adapted such that the cleaning member moves laterally and outwards when the switching means receives a force applied in the first direction. The switching means may include a ramp member having a supporting surface for the cleaning member which is at an oblique angle to the longitudinal axis of the cylindrical body.

The switching means may include means for moving the at least one cleaning member from the active position to the retracted position. The switching means may be adapted to receive a force applied in a second direction. Alternatively, the moving means may be hydraulically or electromagnetically operated.

According to a second aspect of the present invention, there is provided a method of cleaning a well bore, the method comprising:

providing a downhole cleaning tool comprising a substantially cylindrical body having at least one cleaning member extending from the cylindrical body, the cleaning member being movable between a retracted position and an active position in which the cleaning member is positioned to clean an internal surface of the well bore;

inserting the downhole cleaning tool into the well bore until the tool contacts the top edge of a liner such that the tool receives a substantially upwards force which responsively moves the at least one cleaning member from the retracted position to the active position; and carry out cleaning of the internal surface of the well bore.

Preferably the tool is a scraper tool. Preferably a plurality of cleaning members are provided.

Preferably the method includes mounting the at least one cleaning member in a lateral slot which allows lateral movement of the cleaning member relative to the cylindrical body when the tool receives the substantially upwards force.

Preferably the method includes retaining the or each cleaning member at the retracted position until the cleaning member has moved laterally relative to the cylindrical body upon which the cleaning member is allowed to move outwards relative to the cylindrical body.

BRIEF DESCRIPTION OF THE DRAWINGS

An embodiment of the present invention will now be described, by way of example only, with reference to the accompanying drawings, in which.

DETAILED DESCRIPTION

Figure 1:
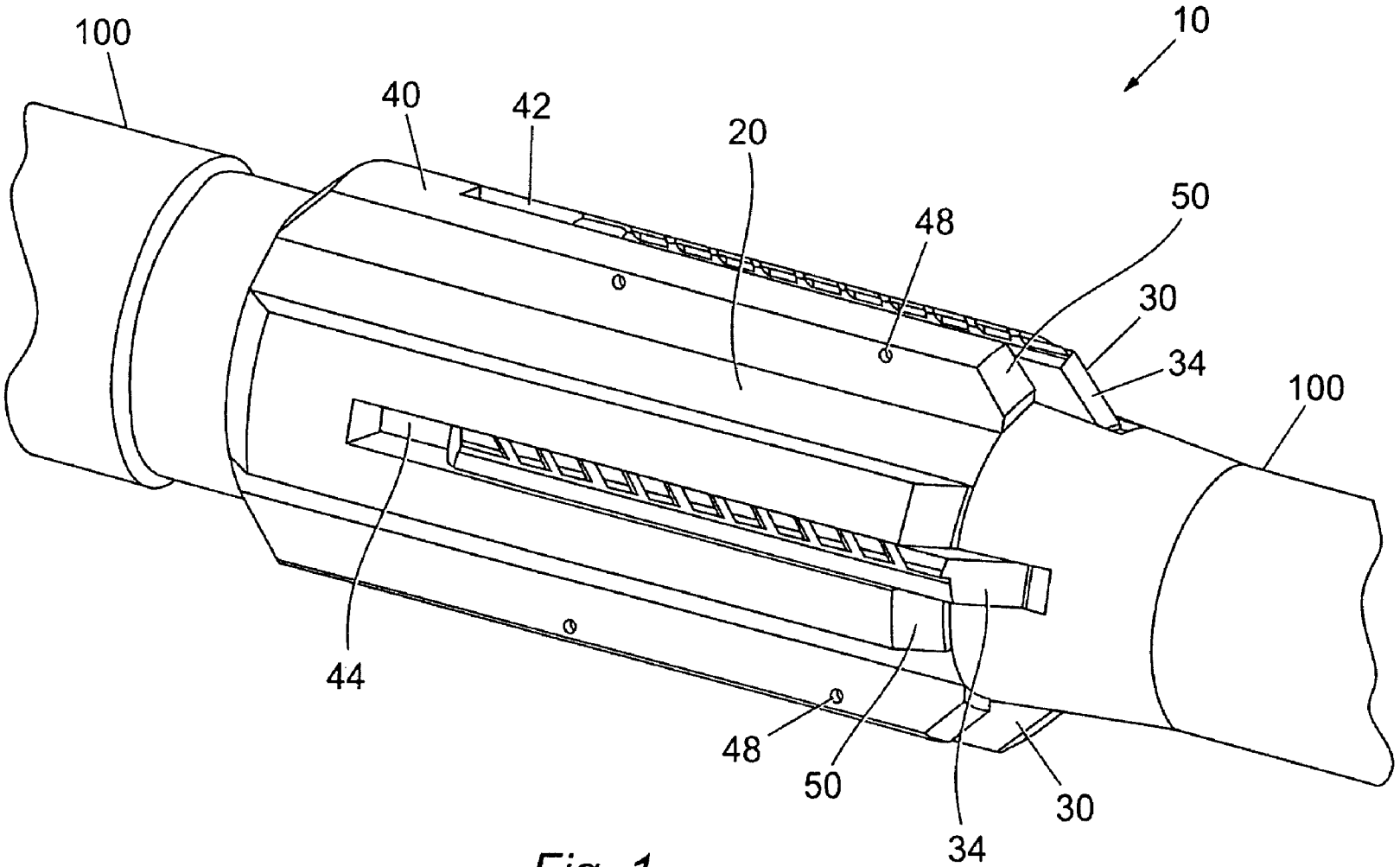
FIG. 1 is a perspective side view of a downhole cleaning tool with cleaning members at a retracted position.

FIG. 1 shows a downhole cleaning tool 10 which comprises a cylindrical body 20 connected within a drill string 100 and four cleaning members or scraping blades 30 which extend outwards from the cylindrical body 20 towards an internal surface of the well bore (not shown).

Figure 2:
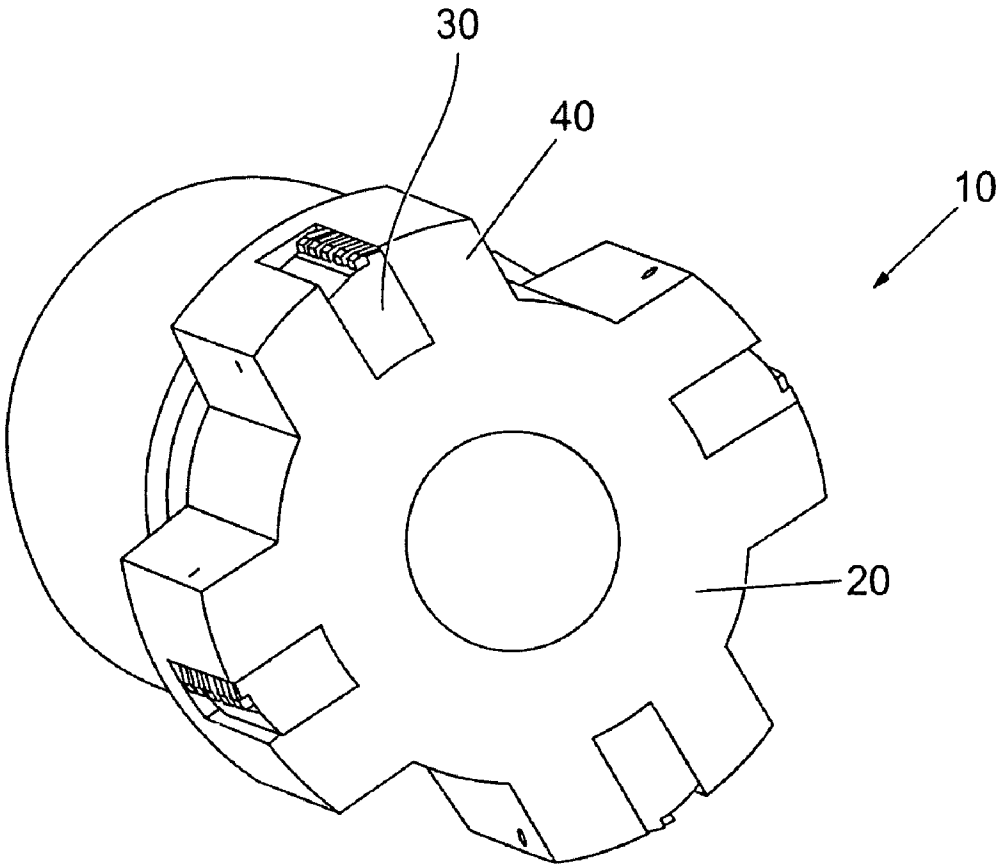
FIG. 2 is a perspective sectional end view of the downhole cleaning tool of FIG. 1.
Figure 3:
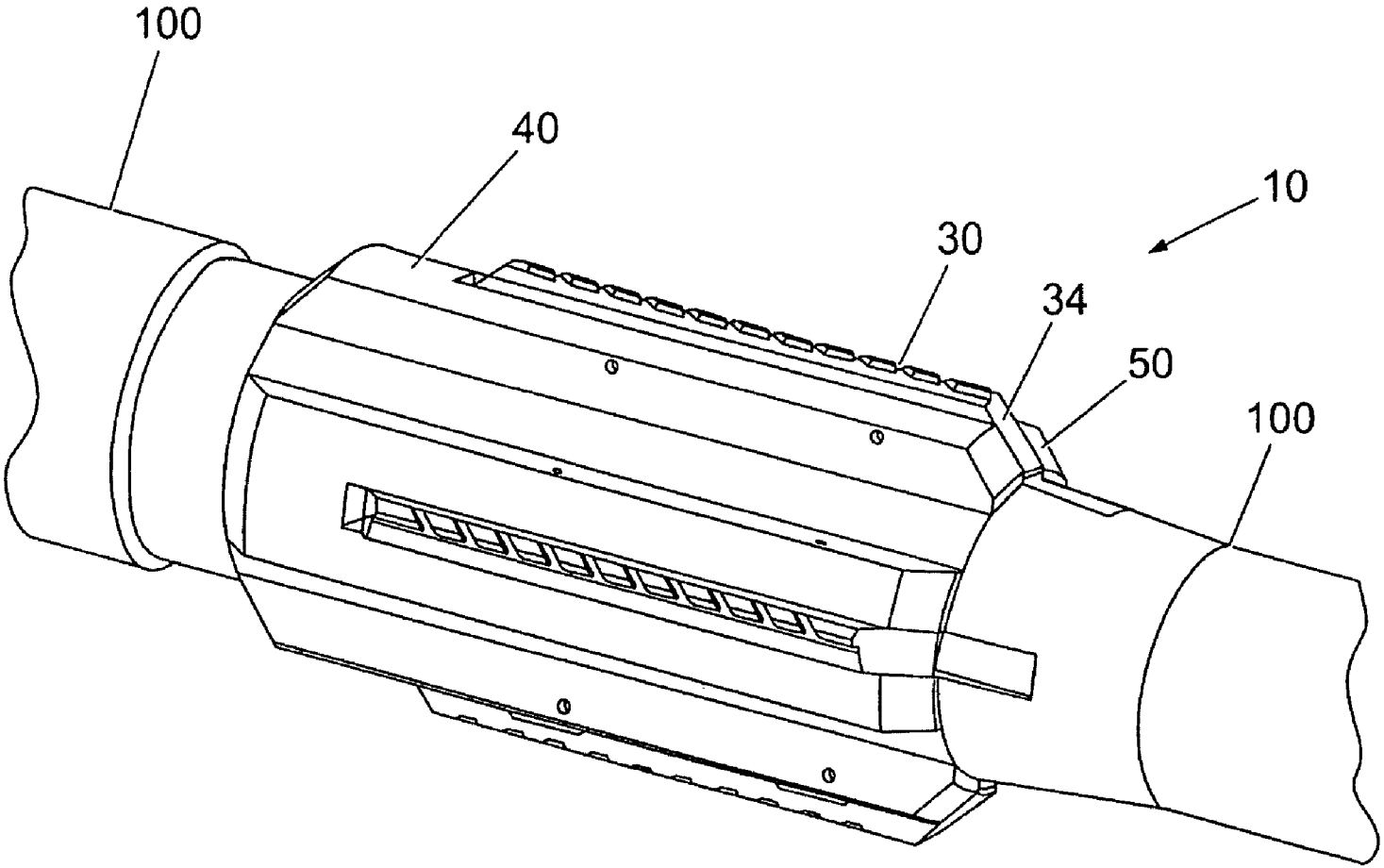
FIG. 3 is a perspective side view of the downhole cleaning tool of FIG. 1 with the cleaning members at an active position.
Figure 4:
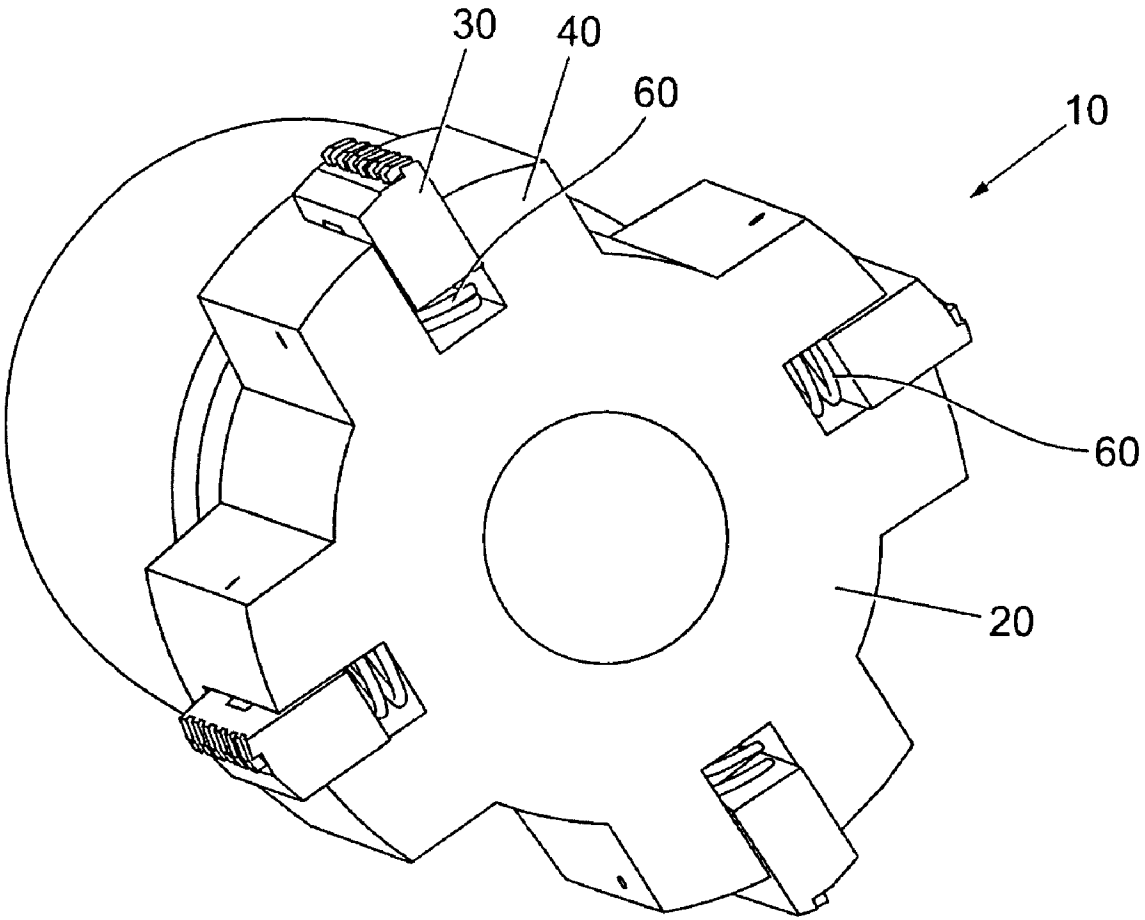
FIG. 4 is a perspective sectional end view of the downhole cleaning tool of FIG. 1 with the cleaning members at an active position.

The scraping blades 30 are movable between a retracted position, as shown in FIGS. 1 and 2, and an active position, as shown in FIGS. 3 and 4. At the active position, the scraping blades 30 contact the internal surface of the well bore and are therefore positioned to clean the internal surface. The scraping blades 30 have a cutting edge that is profiled to scrape the surface at the top of a liner inserted in the well bore.

The downhole cleaning tool includes mounting means for each scraping blade 30. This comprises a lateral slot 42 formed by opposing walls of a mounting block 40. The slot 42 is open at one end. At the retracted position, a portion of each scraping blade 30 laterally extends out of the open end of the respective lateral slot 42. Also, the lateral slot 42 is arranged such that a space 44 exists at the opposite end of the slot 42 when the scraping blade 30 is at this position. This allows the scraping blade 30 to move laterally into the slot 42 taking up the space 44.

Figures 5A, 5B:
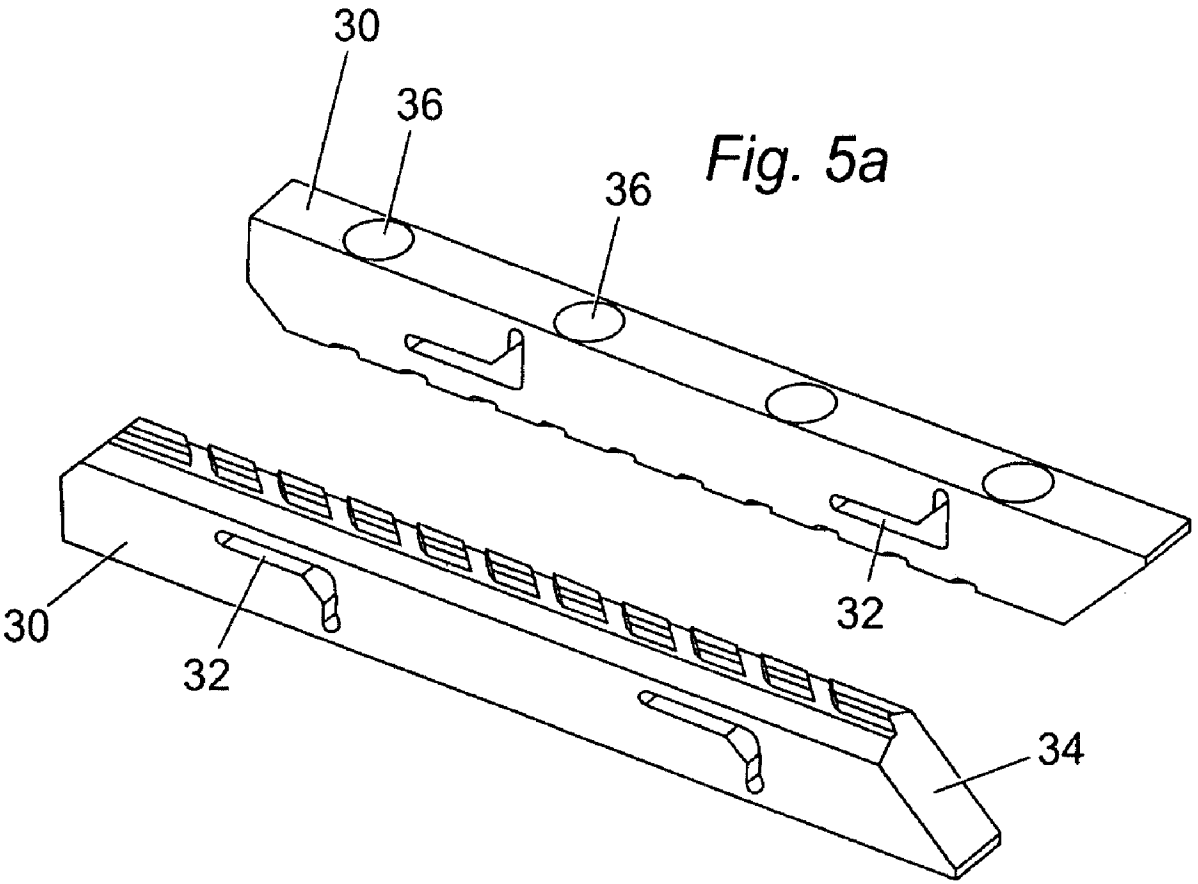
FIGS. 5(*a*) and (*b*) is a perspective bottom view and perspective top view respectively of a cleaning member of the downhole cleaning tool of FIG. 1.
Figure 6:
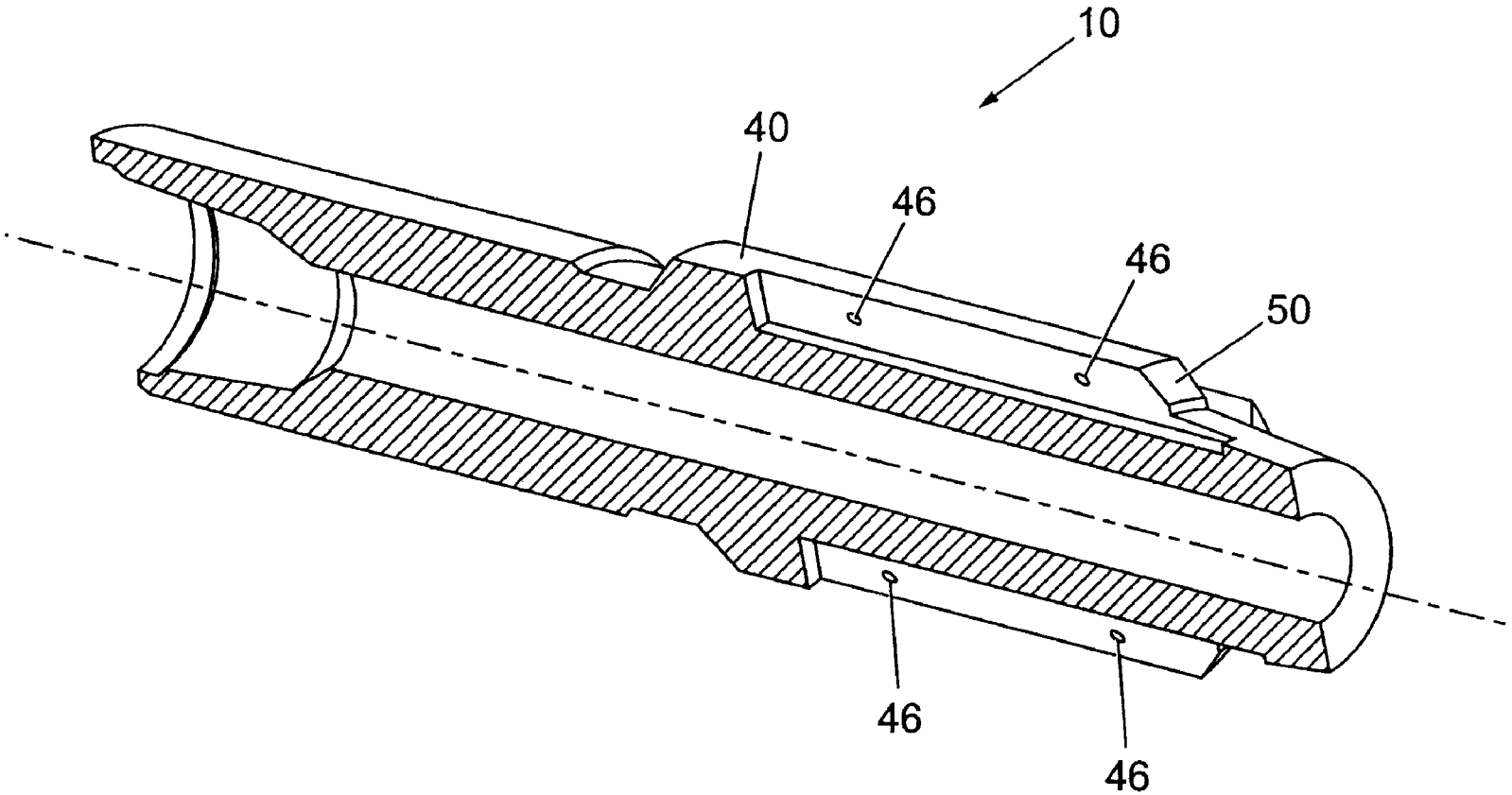
FIG. 6 is a perspective sectional side view of the downhole cleaning tool of FIG. 1.

As seen best in FIG. 6, the opposing walls of each mounting block 40 include aligned apertures 46. As seen best in FIG. 5, each scraping blade 30 includes a mounting slot 32. A roller pin 48 extends through each aperture 46 of one of the opposing walls of the mounting block 40, then through the mounting slot 32 of the scraping blade 30, and then through the aligned aperture 46 of the other of the opposing walls of the mounting block 40. Each lateral slot 42 therefore provides retaining means for retaining the scraping blade 30. However, since the mounting slots 32 extend in a lateral direction, the scraping blades 30 are free to move laterally within the lateral slots 42.

Each mounting slot 32 comprises an 'L' shaped slot as seen in FIG. 5. Therefore, when the retaining roller pin 48 is at one end of the slot 32, the scraping blade 30 is free to move laterally as the roller pin 48 moves along the slot 32 but the scraping blade 30 is constrained from movement in an outwards direction away from the cylindrical body 20. At the other end of the slot 32, the roller pin 48 is free to move along the leg of the 'L' shaped slot 32 allowing the scraping blade 30 to move in an outwards direction away from the cylindrical body 20.

At the retracted position, a portion of the scraping blade 30 laterally extends out of the open end of the lateral slot 42. Therefore, it is this portion, specifically a lower edge 34 of the scraping blade 30, that will receive a force when tool 10 makes contact with the top edge of a liner (not shown) within the well bore. The liner has an internal diameter greater than the outer diameter of the drill string 100 but less than a hypothetical diameter defined by the outer edges of the scraping blades 30. This received force will cause the scraping blades 30 to move laterally within the lateral slots 42 without causing damage to the blades 30.

When the scraping blades 30 have moved fully into the lateral slots 42, a lower edge 50 of each opposing wall of the lateral slots 42 will take up the received force. This lower edge 50 is hardened, such as using carbide, so that the lower edges 50 are not damaged and can even contribute to the scraping action. This contribution will be at the step change in diameter defined the top edge of the liner where significant amounts of slurry tend to accumulate.

A number of springs 60 are provided within spring holding recesses 36 which are located between the scraping blades 30 and the mounting block 40 to bias the scraping blades 30 outwards, although the mounting means prevents any outwards movement while the scraping blades 30 are at the retracted or an intermediary position. When the received force causes the scraping blades 30 to move laterally within the lateral slots 42, the roller pin 48 moves to the other end of the 'L' shaped slot 32, and then along the leg of the slot 32 as the springs move the scraping blade 30 outwards to the active position. The slot 32, as well as the closed end of the lateral slot 42, prevents further lateral movement of the scraping blade 30 when at this position. This arrangement therefore provides switching means adapted to receive a force applied in a first direction and responsively move the scraping blades 30 from the retracted position to the active position.

The retaining means can also be adapted to retain the scraping blades 30 at the active position. This could be the inclusion of a catching member, or the mounting slot 32 could have an additional laterally extending leg (the slot 32 would then effectively be 'S' shaped).

The switching means may include means for moving the scraping blades 30 from the active position to the retracted position against the biasing of the springs 60. This moving means may be hydraulically or electromagnetically operated. This would be particularly advantageous in the event of an obstruction hindering pulling out of the tool.

In an alternative embodiment (not shown), the base surface of the lateral slot 42 may be at an oblique angle to the longitudinal axis of the cylindrical body 20 such that the scraping blades 30 move laterally and progressively outwards when the force is received. This base surface is then effectively a planar ramp. Non-planar base surfaces are also possible so that the scraping blades 30 move laterally and increasingly outwards when the force is received.

In use, the downhole cleaning tool 10 is inserted into the well bore until the scraping blades 30 contact the top edge of the liner. Subsequently, the lower edge 34 of the scraping blades 30 receive an upwards force which responsively moves the scraping blades 30 first laterally and then outwards from the retracted position to the active position. The mounting means then takes up the received force to prevent damage to the scraping blades 30. Cleaning of the internal surface of the well bore can then be carried out.

The present invention is therefore adapted to provide an adequate scraping action at the top of the liner where significant amounts of slurry will accumulate. Damage to the scraping blades 30 is avoided during the cleaning process.

Various modifications and improvements can be made without departing from the scope of the present invention.

In this disclosure, the terms "lateral" and "laterally" are synonymous with the terms "longitudinal" and "longitudinally," respectively.

What is claimed is:

1. A downhole cleaning tool comprising:

a substantially cylindrical body including at least one mounting slot; and at least one cleaning member slidably located in the mounting slot and being movable between a retracted position and an active position by sliding in the mounting slot in a direction parallel to a longitudinal axis of the cylindrical body;

wherein part of the cleaning member extends from the slot when in the retracted position and that part of the cleaning member receives a force applied in the direction parallel to the longitudinal axis and responsively moves the at least one cleaning member from the retracted position towards the active position.

2. The tool as claimed in claim 1, wherein the tool is a scraper tool and the at least one cleaning member comprises a scraping blade.

3. The tool as claimed in claim 1, wherein a plurality of mounting slots and respective cleaning members are provided.

4. The tool as claimed in claim 1, further comprising at least one mounting block extending from the cylindrical body, wherein the mounting slot is formed in the mounting block.

5. The tool as claimed in claim 4, wherein the mounting block is adapted to allow the movement of the cleaning member relative to the cylindrical body when the cleaning member receives the force applied in the direction parallel to the longitudinal axis.

6. The tool as claimed in claim 5, wherein the mounting block takes up the received force after sufficient movement of the cleaning member in the direction parallel to the longitudinal axis.

7. The tool as claimed in claim 4, wherein the mounting block is adapted to allow the cleaning member to move outwards relative to the cylindrical body following sufficient movement of the cleaning member relative to the cylindrical body in the direction parallel to the longitudinal axis.

8. The tool as claimed in claim 1, and further comprising biasing means for biasing the or each cleaning member towards the active position.

9. The tool as claimed in claim 1, and further comprising retaining means for selectively retaining the or each cleaning member at the retracted position.

10. The tool as claimed in claim 9, wherein the retaining means retains the or each cleaning member at the retracted position until the cleaning member has moved relative to the cylindrical body in the direction parallel to the longitudinal axis.

11. The tool as claimed in claim 9, wherein the retaining means includes the at least one mounting slot.

12. The tool as claimed in claim 11, wherein the mounting slot comprises an 'L' shaped slot.

13. The tool as claimed in claim 1, and further comprising means for moving the at least one cleaning member from the active position to the retracted position.

14. A method of cleaning a well bore, the method comprising the steps of:

providing a downhole cleaning tool comprising a substantially cylindrical body including at least one mounting slot, and at least one cleaning member slidably located in the mounting slot, the cleaning member being movable between a retracted position and an active position by sliding in the mounting slot in a direction parallel to a longitudinal axis of the cylindrical body, and wherein part of the cleaning member extends from the slot when in the retracted position;

inserting the downhole cleaning tool into the well bore until the part of the cleaning member receives a force in the direction parallel to the longitudinal axis which responsively moves the cleaning member from the retracted position to the active position; and carry out cleaning of the internal surface of the well bore.

15. The method as claimed in claim 14, wherein the tool is a scraper tool.

16. The method as claimed in claim 14, further comprising the step of:

retaining the or each cleaning member at the retracted position until the cleaning member has moved relative to the cylindrical body in the direction parallel to the longitudinal axis, upon which the cleaning member is allowed to move outwards relative to the cylindrical body.

* * * * *